US005443705A

United States Patent [19]

Miller et al.

[11] Patent Number: 5,443,705

[45] Date of Patent: Aug. 22, 1995

[54] ELECTROREFINER

[75] Inventors: William E. Miller, Naperville; Zygmunt Tomczuk, Lockport, both of Ill.

[73] Assignee: The United States of America as represented by the United States Department of Energy, Washington, D.C.

[21] Appl. No.: 272,376

[22] Filed: Jul. 6, 1994

[51] Int. Cl.[6] ..... C25C 7/08; C25B 9/00

[52] U.S. Cl. ..... 204/227; 204/228; 204/243 R; 204/250

[58] Field of Search ..... 204/250, 219–220, 204/243 R, 245, 221–222, 217, 64 R

[56] References Cited

U.S. PATENT DOCUMENTS

| | | | |
|---|---|---|---|
| 2,843,544 | 7/1958 | Morana | 204/227 |
| 2,948,663 | 8/1960 | Dean et al. | 204/245 X |
| 2,951,793 | 9/1960 | Hansen | 204/1.5 |
| 3,589,995 | 6/1971 | McChesney | 204/250 X |
| 3,905,880 | 9/1975 | Lee et al. | 204/250 X |
| 4,242,192 | 12/1980 | Dunning, Jr. et al. | 204/213 |
| 4,303,491 | 12/1981 | Ferrari et al. | 204/250 X |
| 4,596,647 | 6/1986 | Miller et al. | 204/212 |
| 4,668,369 | 5/1987 | King | 204/227 |
| 4,855,030 | 8/1989 | Miller | 204/212 |
| 4,880,506 | 11/1989 | Ackerman et al. | 204/1.5 |
| 4,995,948 | 2/1991 | Poa et al. | 204/1.5 |
| 5,009,752 | 4/1991 | Tomczuk et al. | 204/64 |
| 5,348,626 | 9/1994 | Miller et al. | 204/1.5 |
| 5,356,605 | 10/1994 | Tomczuk et al. | 423/251 |

*Primary Examiner*—Donald R. Valentine

*Attorney, Agent, or Firm*—Tim Harney; Hugh Glenn; William R. Moser

[57] ABSTRACT

An apparatus capable of functioning as a solid cathode and for removing crystalline structure from the upper surface of a liquid cathode, includes a metallic support vertically disposed with respect to an electrically insulating container capable of holding a liquid metal cathode. A piston of electrically insulating material mounted on the drive tube, surrounding the current lead, for vertical and rotational movement with respect thereto including a downwardly extending collar portion surrounding the metallic current lead. At least one portion of the piston remote from the metallic current lead being removed. Mechanism for lowering the piston to the surface of the liquid cathode and raising the piston from the surface along with mechanism for rotating the piston around its longitudinal axis.

16 Claims, 2 Drawing Sheets

ELECTROREFINER

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

BACKGROUND OF THE INVENTION

This invention relates to a process and apparatus for electrochemically refining spent nuclear fuel from a nuclear reactor and recovering purified uranium and a mixture of uranium and plutonium for use as fresh blanket and core fuel in a nuclear reactor. The invention relates to a electrorefiner of the type wherein spent blanket and core fuel is refined in a single electrorefining cell by transferring uranium and plutonium from the spent fuel optionally to a molten cadmium pool or directly to an electrolyte and thereafter electrolytically depositing purified uranium on a solid cathode and subsequentially electrolytically depositing a mixture of uranium and plutonium on a second liquid metal cathode, preferably cadmium. More particularly, this invention relates to a device and apparatus which is capable of functioning both as a solid cathode and a liquid cathode in an electrolytic cell of the type hereinbefore described.

Electrorefining processes have been generally used to recover high purity metal or metals from impure feed materials and more particularly to recover materials such as uranium and plutonium from spent nuclear fuel. Electrorefining of spent nuclear fuel is carried out in a electrolysis cell of the kind disclosed in U.S. Pat. Nos. 2,951,793, 4,596,647, 4,880,506, 4,855,030 and 5,009,752, the disclosures of each of these patents being incorporated herein by reference and are generally indicative of the prior art in this field, with the '030 patent being particularly relevant since the present invention is an improvement of the device disclosed therein.

In such cells as disclosed in the above-mentioned patents, the spent nuclear fuel forms the anode or is dissolved in an anode pool. An electrolytic cell is used, and the purified metal is transferred electrochemically and collected on the cathode. In other designs, an anode pool is located at the bottom of the cell, and the cathode may be located above the anode in the electrolyte pool. It has been shown in the prior art that relatively pure uranium can be electrolytically deposited on a solid cathode and thereafter mixtures of uranium and plutonium can be deposited on a molten metal cathode such as cadmium, see the above-identified U.S. Pat. No. 4,880,506. In all of the art cited above, and in the electrorefining process as it now exists, the cathode design is such that different mechanism are required for the liquid cathode and for the solid cathode, it being understood that the solid cathode is used to separate and collect substantially pure uranium while the liquid cathode is used to separate and collect mixtures of plutonium and uranium. There is an advantage to providing the same mechanism for an electrolytic cell which can be used either to collect substantially pure uranium deposited on a solid cathode or to collect both uranium and plutonium values on the surface of a liquid cathode.

Moreover, when plutonium and uranium are collected on the surface of a liquid cathode, there is the additional problem of the dendrites which are formed on the surface thereby necessitating mechanisms for mixing dendrites into the pool of liquid cadmium which serves as the liquid metal cathode. To this end, reference is made to U.S. Pat. No. 4,855,030 cited above which is specifically directed to the problem of removing dendrites from the surface of the liquid cadmium.

SUMMARY OF THE INVENTION

Accordingly, it is an object of the present invention to improve the collection efficiency of mixed uranium and plutonium values from spent nuclear fuel in an electrorefiner.

It is another object of the invention to provide an apparatus which may be used either as a solid cathode to collect substantially pure uranium values or as a liquid cathode to collect mixed values of uranium and plutonium Another object of the invention is to provide a mechanism for removing dendrites of mixed uranium and plutonium values from the surface of a liquid cathode.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
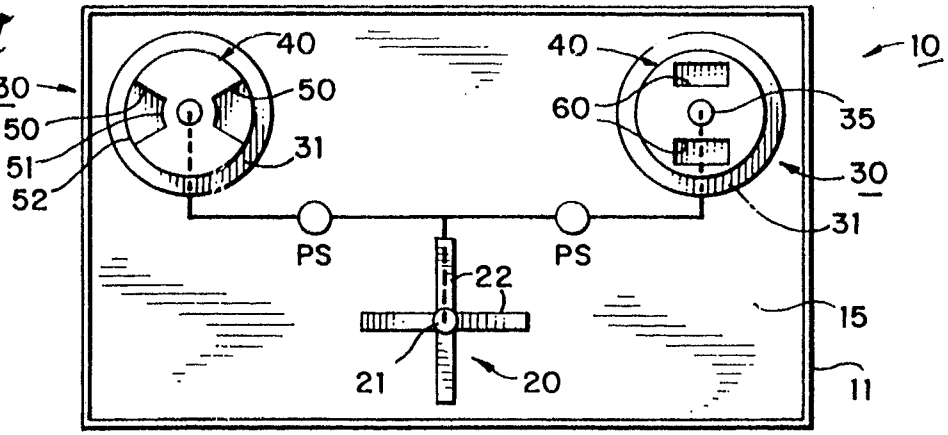
FIG. 1 is a schematic representation of a power supply arrangement for an electrolytic cell of the type herein disclosed.

Referring now to the drawings, there is disclosed in FIG. 1, an electrolytic cell 10 of the type hereinbefore referred to for the electrorefining spent nuclear fuel. More particularly, the cell 10 includes a container 11 which houses a molten salt electrolyte 15. The molten salt electrolyte 15 may include various halides of the alkali and alkaline earth metals, it being understood that the preferred salt is the eutectic of lithium and potassium chloride which also may contain the chlorides of uranium and plutonium during operation of the cell or refiner 10. The exact make-up of the electrolyte 15 is well known and is to some extent dependent upon the use for which the cell is operating. In addition, as is understood, the plutonium to uranium ratio in the cell 10 varies depending on what part of the cycle measurements are taken.

An anode 20 is located within the cell or refiner 10 and is specifically immersed within the electrolyte 15, as is well known in the art. The anode 20 design is specifically adapted to enhance the flow of electrolyte 15 through and around the anode container 22 which may be in the form of apertured baskets mounted on a central support 21, all as well recognized and understood in the art. The anode 20 may be designed in a variety of configurations, none of which is critical to the present invention configured and arranged to provide maximum contact of the electrolyte with the spent nuclear fuel chopped into segments and maintained in the anode baskets 22 as is understood.

A plurality of cathodes are provided in the cell or electrorefiner 10, there generally being two different types of cathodes, one solid for the collection of substantially pure uranium values and the other being liquid for the collection of mixed uranium and plutonium values, all as well understood in the art.

Figure 3:
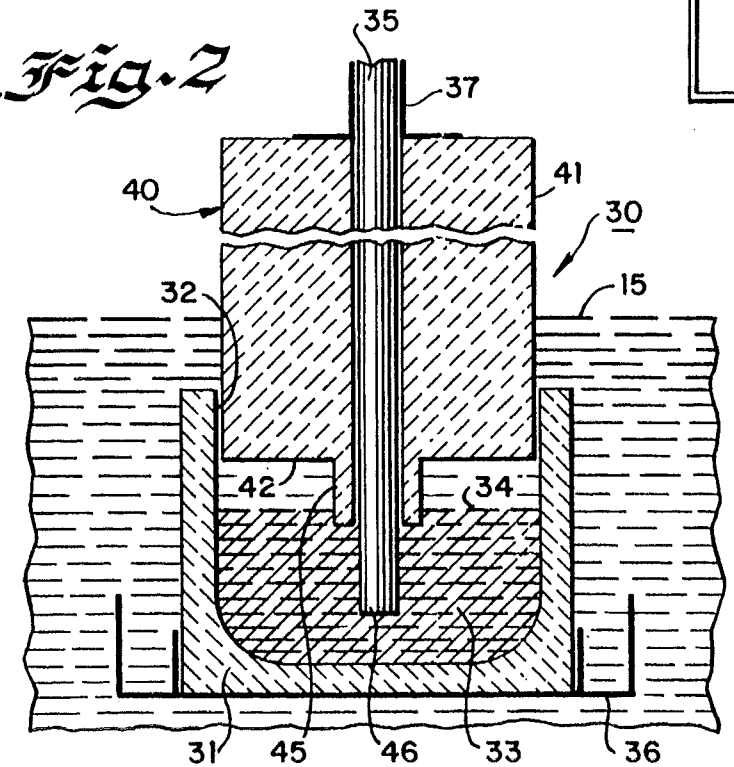
FIG. 3 is a cathode of the type useful in the electrolytic cell illustrated in FIG. 2 wherein the piston is in the down position.
Figure 2:
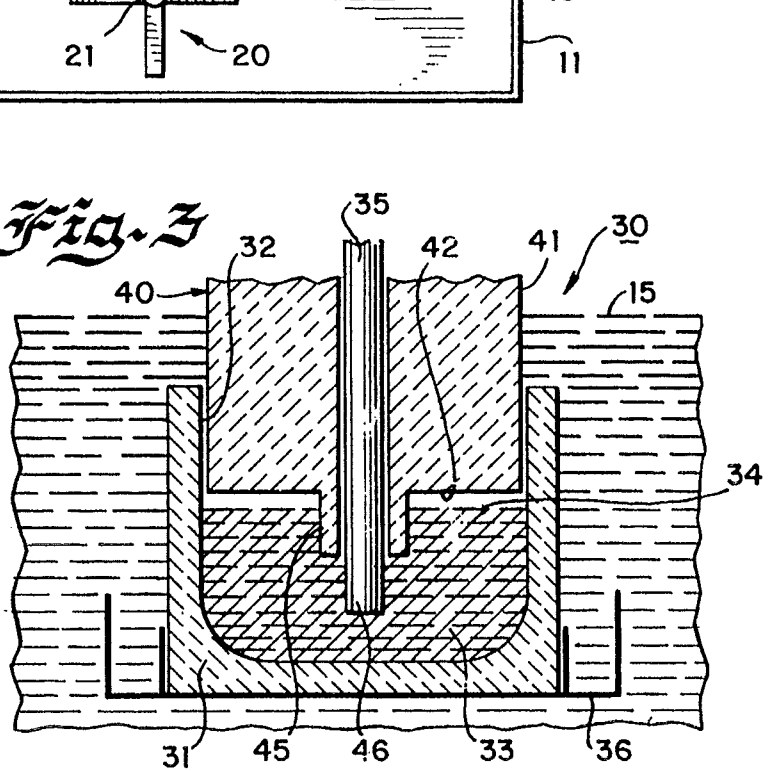
FIG. 2 is a view of a cathode of the type useful in the electrolytic cell illustrated in FIG. 1 having a liquid metal therein, wherein the associated piston is in the up position.

Referring now to FIG. 2, there is disclosed a liquid cathode 30 which includes a container 31 preferably in the form of a cylindrical crucible of ceramic or other non-electrically conducting material having an inner surface 32 in the form of a cylinder. Housed within the cathode 30 is a liquid metal preferably cadmium having a liquid surface 34. The liquid cathode 30 is submerged within the cell electrolyte 15 as illustrated and as provided with an axially and vertically extending metal support 36. A metal drive tube 37 is provided for vertical and rotational movement of the attached ceramic piston 40. The ceramic piston 40 has an outer cylindrical surface 41 and a bottom circular surface 42 having at the center a downwardly extending collar 45 having a distal end surface 46 forming an annulus about the metal current lead member 35. The piston 40 as illustrated in FIGS. 2 and 3 is movable from an upward position illustrated in FIG. 2 to a downward position illustrated in FIG. 3. In the upward position of FIG. 2, it is important to note that the piston 40 protects the current lead 35 from contact with the electrolyte 15 by extending above the surface of the electrolyte 15 on the one hand and having the collar portion 45 and distal end 46 thereof extending below the surface of the liquid metal or cadmium layer 34 on the other hand. By virtue of the fact that the piston 40 extends above and below the electrolyte 15 level, and more particularly into the molten cadmium layer 33 electrolyte 15 is effectively prevented from continuously contacting the metal current lead 35. The purpose of this construction is to prevent the deposition of uranium on the current lead 35 while the liquid cathode or cadmium 33 is acting to separate mixed plutonium and uranium which have been transferred from the anode 20 to the electrolyte 15, all as is well known in the art. It is further understood that the piston 40, like the crucible 31, has to be a non-electrical conducting material, such as a ceramic like $Al_2O_3$, BeO or other suitable material.

Figure 4:
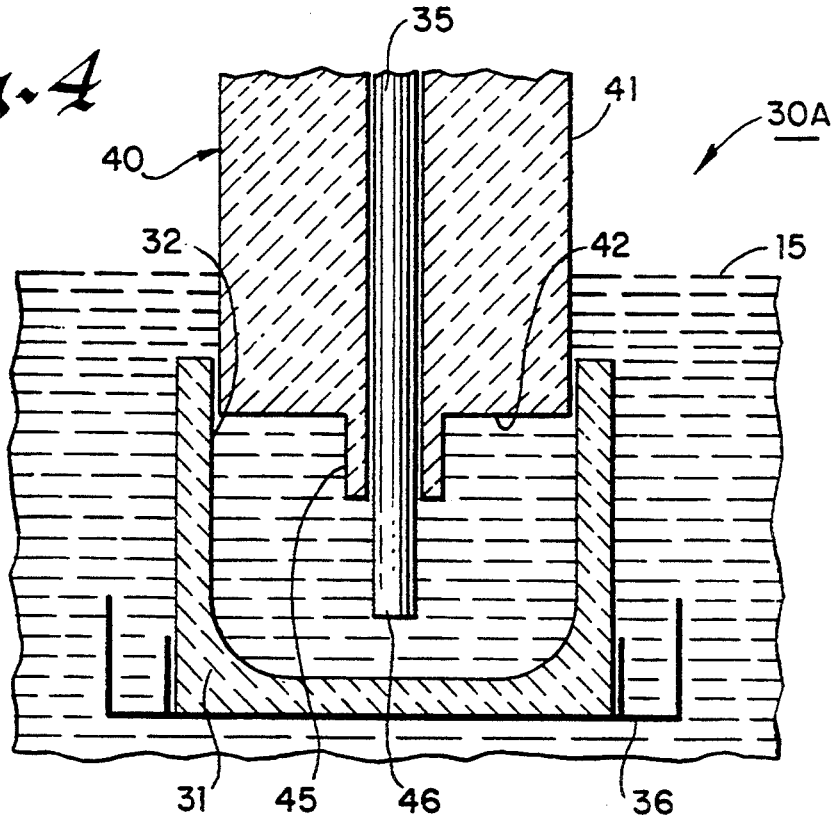
FIG. 4 is a schematic view of a cathode of the type useful in the electrolytic cell illustrated in FIG. 1 wherein the piston is in the up position for a solid cathode.
Figure 5:
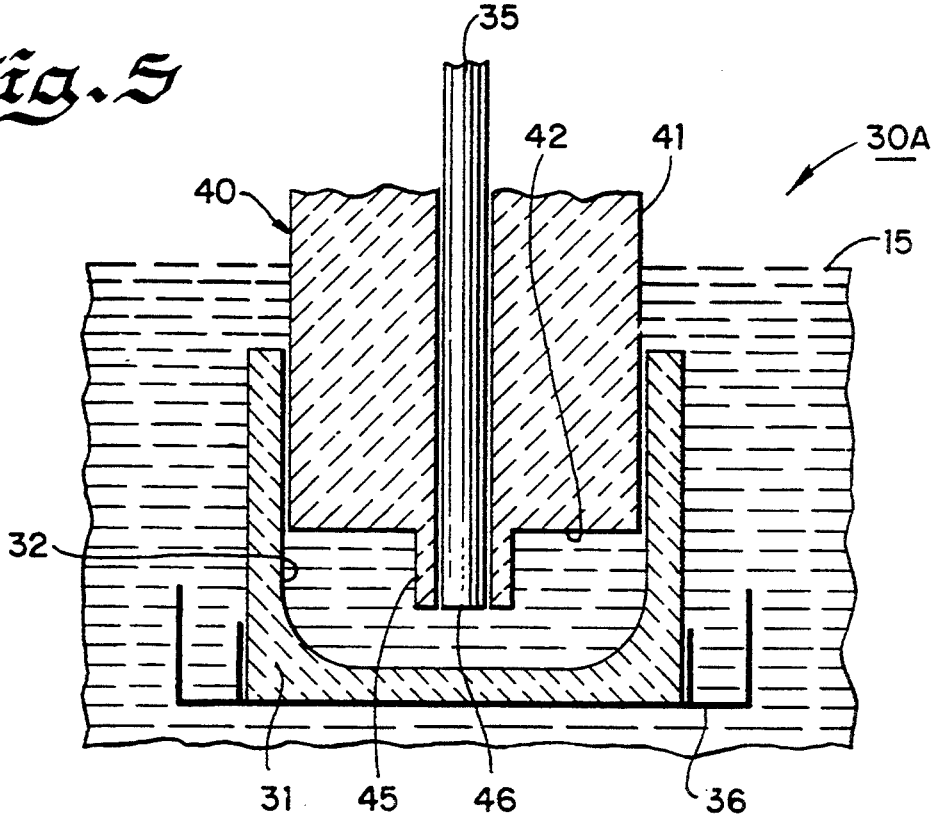
FIG. 5 is a view of the cathode illustrated in FIG. 4 wherein the piston is in the down position.

Referring to FIGS. 4 and 5, there is shown the cathode 30A constructed and arranged to function as a solid cathode for the deposition of uranium values thereon. The cathode 30A is the same mechanically, as the cathode 30 but does not have the liquid metal 33, such as cadmium therein, using the metal tube or rod current lead 35 as the cathode. In the present situation, electrolyte 15 is able to flow into the container 31 to take the place of the liquid metal 33 and thereby contact the metal tube or rod 35 depositing substantially pure uranium values on the tube or rod 35. The collar 45 acts as a scraper assembly during the vertical movement of the piston 40 between its up position illustrated in FIG. 4 and the down position illustrated in FIG. 5. Uranium which is deposited on the metal rod or tube 35 is scraped by contact with the collar 45 of the piston 40 and falls to the bottom of the crucible or container 31 and is thereafter collected.

The piston 40 is provided with a series of removed portions 50 which may have an inner surface 51 spaced from the rod or tube 35 and a periphery 52 which may or may not intersect the outer surface 41 of the piston 40. A removed portion 60 may lie entirely within the piston 40 as illustrated in FIG. 1, it being appreciated that the removed portion provides for greater contact between the electrolyte and the surface of the liquid metal 33 when the construction is used as a liquid metal cathode. It has been found that configuring the piston 40 with two or more removed portions 50, 60 is preferable to the construction illustrated in the '030 patent. Moreover, the pie-shaped removed portion of the '030 patent extending to the central support is inoperable in the present invention, since such a construction would expose the solid cathode 35 to the electrolyte when liquid metal 33 is present. Pie-shaped removed portions 50 are acceptable if the apex does not extend to the rod or tube 35, leaving non-conducting material to prevent the electrolyte 15 from contacting the solid cathode 35 when liquid metal 33 is present. The piston 40 must have sufficient weight to create a force great enough to push the dendrites of mixed plutonium and uranium below the surface 34 of the liquid metal 33, but the piston 40 does not actually have to contact the surface 34 of the liquid metal 33.

While the up and down movement of the piston 40 is important to cause the dendrites of mixed uranium plutonium which occur on the surface of the cadmium 33 to be pushed down below the surface 34 of the molten cadmium layer to mix the dendrites into the cadmium as is described in the '030 patent it is also important to rotate the piston 40 so that electrolyte 15 can come in contact with all portions of the cadmium surface 34 and so all portions of the cadmium surface is exposed to a downward force when the construction 30 is used as a liquid cathode.

By using the piston 40 with the collar 45, and the new removed portions 50, 60, the present invention allows the same construction to be used as a liquid cathode 30 or a solid cathode 30A, the piston 40 being useful both as mechanism for mixing the dendrites into the liquid metal 33 and as a scraper for uranium deposited on the solid cathode 35.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. An apparatus for removing crystalline structure from the upper surface of a liquid cathode, comprising a support vertically disposed with respect to said liquid cathode, a current lead tube or rod, a cylindrical piston of electrically insulating material mounted on said support for vertical and rotational movement with response thereto, at least two portions of said piston remote from said support being removed therefrom, motor mechanism for lowering said piston to the surface of the liquid cathode and raising said piston from said surface, and mechanism for rotating said piston around its longitudinal axis.

2. The apparatus of claim 1, wherein the liquid cathode is Cd.

3. The apparatus of claim 1, wherein said liquid cathode is contained in an electrically insulating ceramic container.

4. The apparatus of claim 3, wherein said support is axially disposed with respect to said ceramic container.

5. The apparatus of claim 4, wherein said piston is ceramic.

6. The apparatus of claim 5, wherein at least one of said removed portions intersects the piston periphery.

7. The apparatus of claim 5, wherein at least two of said removed portions intersect the piston periphery.

8. The apparatus of claim 7, wherein the removed portions do not extend to said support.

9. The apparatus of claim 4, wherein said removed portion of said piston is pie-shaped with the apex of the pie-shaped from the axial extending vertical support.

10. The apparatus of claim 4, wherein said removed portion of said piston is completely within said piston.

11. The apparatus of claim 4, wherein said motor mechanism raises and lowers said piston along said current lead, said collar extending into the liquid cathode metal when said piston is in its raised position.

12. An apparatus capable of functioning as a solid cathode and for removing crystalline structure from the upper surface of a liquid cathode, comprising: a current lead, vertically disposed with respect to an electrically insulating container capable of holding a liquid metal cathode, a piston of electrically insulating material mounted on said metallic support for vertical and rotational movement with respect thereto including a downwardly extending collar portion surrounding said metallic support, at least one portion of said piston remote from said metallic support being removed therefrom, motor mechanism for lowering said piston to the surface of the liquid cathode and raising said piston from said surface, and mechanism for rotating said piston around its longitudinal axis.

13. The apparatus of claim 12, wherein said container is a ceramic cylinder.

14. The apparatus of claim 12, wherein said metallic support is ferrous or ferrous based and functions as a solid cathode.

15. An electrolytic cell for refining a spent nuclear fuel, comprising a molten salt electrolyte surrounding electrode means including at least one cathode capable of functioning as a solid cathode or a liquid cathode, said cathode including an electrically insulating container circular in transverse cross section and a vertically extending metallic support associated therewith, an anode adapted to be in contact with said molten salt electrolyte, a cylindrical piston of electrically insulating material mounted on said metallic support for vertical and rotational movement with respect thereto and having a collar extending downwardly therefrom, at least two portions of said piston remote from said metallic support being removed therefrom, mechanism for cyclically lowering said piston to the surface of the liquid cathode and raising said piston from said surface, mechanism for rotating said piston around its longitudinal axis, and electrical power means selectively connected to said anode and cathode for providing electrical power to the cell.

16. The electrolytic cell of claim 15, wherein said anode includes spent nuclear fuel containing uranium and plutonium, said salt electrolyte includes the chlorides of K and Li, said metallic support when functioning as a solid cathode having substantially pure uranium deposited thereon with vertical movement of said piston therealong scraping deposited uranium therefrom, said cathode when functioning as a liquid cathode having liquid Cd in said container with said piston movable vertically from a position spaced from the Cd surface to a position close to the Cd surface such that dendrites of mixed Pu and U values are forced into the liquid Cd, said collar on said piston remaining below the surface of the liquid Cd when said piston is spaced from the Cd surface to prevent contact of the electrolyte salt and said metallic support and the top of said piston remaining above the surface of the electrolyte when the piston is in close to the surface of the liquid Cd.

* * * * *